US006406135B1

(12) United States Patent
Watanabe et al.

(10) Patent No.: US 6,406,135 B1
(45) Date of Patent: Jun. 18, 2002

(54) INK JET RECORDING HEAD AND RECORDING APPARATUS USING THE SAME

(75) Inventors: Kenjiro Watanabe, Tokyo; Akio Saito, Machida; Taiji Yoshinari, Ninomiya-machi; Yohei Sato, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/640,585

(22) Filed: Aug. 18, 2000

(30) Foreign Application Priority Data

Aug. 23, 1999 (JP) ..... 11-235757

(51) Int. Cl.[7] ..... B41J 2/05; B41J 2/19
(52) U.S. Cl. ..... 347/65; 347/92
(58) Field of Search ..... 347/63, 65, 67, 347/92, 94, 20, 56

(56) References Cited

U.S. PATENT DOCUMENTS 5,971,527 A * 10/1999 Peeters et al. ..... 347/65

FOREIGN PATENT DOCUMENTS

JP 2-187353 A * 7/1990 ..... 347/65

* cited by examiner

*Primary Examiner*—John Barlow
*Assistant Examiner*—Juanita Stephen
(74) *Attorney, Agent, or Firm*—Fitzpatrick, Cella, Harper & Scinto

(57) ABSTRACT

An ink jet recording head including a discharge port for discharging ink, a liquid flow path that communicates with the discharge port and having a heat energy generating element for generating a heat energy to be utilized for discharging the ink, a common liquid chamber disposed for supplying the ink into the liquid flow path as the ink is discharged and located after the liquid flow path and an ink supply port for supplying the ink into the common liquid chamber, in which the common liquid chamber has a curved surface convex inward of the liquid chamber in a region adjacent to the ink supply port.

10 Claims, 14 Drawing Sheets

INK JET RECORDING HEAD AND RECORDING APPARATUS USING THE SAME

FIELD OF THE INVENTION

The present invention relates to an ink jet cartridge which discharges ink using a pressure produced by a bubble and an ink jet recording apparatus which uses the ink jet cartridge.

RELATED BACKGROUND ART

It has conventionally been known that an ink jet recording apparatus which performs recording by discharging a recording liquid (ink) from an orifice of a liquid ejecting head is a recording apparatus excellent from viewpoints of low noise and high speed recording.

Speaking of recording method which uses this ink jet recording apparatus, various types of methods have hitherto been proposed and improved: some have been placed on the market, whereas endeavors are being made to put others to practical use.

Above all, it is demanded to lower a manufacturing cost and improve discharging performance of a recording head of a type which comprises as an ink jet recording head, a substrate having an energy generating element for generating an ejecting energy and a ceiling plate joined to the substrate for forming a liquid flow path for discharging ink and a liquid chamber.

In order to meet a demand described above, the inventor et al. have manufactured a recording head shown in FIG. 10. FIG. 10 is a sectional view taken in a direction of a flow path showing a configurational example of an ink discharge unit constituting a background art of the present invention and FIG. 11 is an enlarged view of a vicinity of a liquid chamber shown in FIG. 10. Furthermore, FIGS. 12A, 12B and 12C are diagrams showing a form of the liquid chamber: FIG. 12A being a view as seen from a side of a discharge port, FIG. 12B being a top view and FIG. 12C being a side view.

As shown in FIGS. 10 and 11, the background art is configured by a base plate 1 made of a metal such as aluminum, a heater board 2 which is disposed on the base plate 1 and composed of a silicon substrate or the like on which a heater array for discharging ink is arranged, a printed wiring board 10 for transmitting an electric signal to the heater array on the heater board 2 by way of a bonding wire 11, a plurality of discharge ports 3 for discharging ink, a plurality of flow paths 4 which communicate with the plurality of discharge ports 3 respectively and supply the ink to the discharge ports 3, a liquid chamber 5 which communicates with the flow paths 4 and holds the ink to be supplied to the flow paths 4, a supply path 6 which communicates with an ink tank (not shown) and supplies ink from the ink tank to the liquid chamber 5, a supply tube 9 which forms the supply path 6, a grooved ceiling plate 7 which integrally forms the flow paths 4, the liquid chamber 5 and a portion of the supply path 6, and a clamp spring 8 which fixes the grooved ceiling plate 7: the discharge port 3 being formed by a laser boring method after the flow paths 4, the liquid chamber 5 and the portion of the supply path 6 are formed in the grooved ceiling plate 7 by plastic molding. Furthermore, the liquid chamber 5 is communicated with the supply path 6 by an opening 13 as shown in FIGS. 12A, 12B and 12C so that the ink is supplied from the ink tank into the liquid chamber 5 by way of the opening 13.

The opening 13 of the liquid chamber 5 is formed not in a top surface of the liquid chamber 5 but in a rear surface which is opposed to the flow paths 4. It is desirable to configure the heater board 2 as small as possible in order to reduce a manufacturing cost and a size of the liquid chamber 5 is limited, but since the top surface of the grooved ceiling plate 7 must have an area which is used to fix the grooved ceiling plate 7 with the clamp spring 8 and the supply tube 9 cannot be disposed on the top surface of the liquid chamber 5, the ink is supplied from behind the liquid chamber 5.

In the ink jet cartridge which uses the ink discharge unit configured as described above, a sucking operation is first performed by a sucking device (not shown) of an ink jet recording apparatus main unit by way of the discharge port 3, whereby the ink is supplied from the ink tank into the flow path 4.

Then, the heaters on the heater board 2 generate heat on the basis of the electric signal transmitted from the printed wiring board 10, whereby a bubble is produced in the flow path 4 and the ink is discharged from the discharge port 3 under a pressure produced by the bubble.

FIGS. 13A, 13B, 13C and 13D are diagrams descriptive of a series of operations from ink discharge to suction in the ink jet cartridge which uses the ink discharge unit shown in FIG. 10.

When a heater 23 on the heater board 2 generates heat on the basis of the electric signal transmitted from the printed wiring board 10, the ink is heated and boiled by the heat in the flow path 4, thereby forming a bubble 24 on the heater 23. The ink is discharged from the flow path 4 through the discharge port 3 under a pressure produced by the bubble 24 (FIG. 13A). At this time, a small number of small bubbles 26 may be produced upstream of the flow path 4.

The small bubble (bubbles) 26 produced on the upstream side of the flow path 4 are stagnant in the liquid chamber 5 even after the bubble 24 disappears on the heater 23 (FIG. 13B).

When the heater 23 on the heater board 2 generates heat once again thereafter on the basis of the electric signal transmitted from the printed wiring board 10, the ink is heated and boiled by the heat in the flow path 4 and the bubble 24 is produced on the heater 23, and the small bubble (bubbles) 26 move upstream of the liquid chamber 5 under a pressure produced by the bubble 24 and adhere to a ceiling surface of the liquid chamber 5 together with the small bubble (bubbles) 27 coming from the supply path 6, thereby forming a bubble 14 (FIG. 13C).

An ink jet recording apparatus performs a suction recovery at an improper printing time. A bubble is removed by bringing a suction pad 28 into contact with a surface of the discharge port 3 as shown in FIG. 13D and sucking the ink out of the flow path 4.

However, the inventor et al. have found that the bubble 14 adhering to the ceiling surface of the liquid chamber 5 is not sucked but remains and a small bubble 30 also remains upstream of the flow path 4 in some cases dependently on kinds of ink since the background art forms in the liquid chamber 5 an ink flow 12 which has a high flow velocity in a region indicated by an arrow and an ink flow 29 which has a low flow velocity in the vicinity of the ceiling surface of the liquid chamber 5 at the suction time.

FIGS. 14A, 14B, 14C and 14D are diagrams descriptive in detail of the bubble 14 remaining after the operations shown in FIGS. 13A, 13B, 13C and 13D: FIG. 14A being a sectional view taken in a direction of a flow path of the ink jet cartridge, FIG. 14B being a view of the liquid chamber 5 as seen from a side of the discharge port, FIG. 14C being a top view of the liquid chamber 5 and FIG. 14D being a side view of the liquid chamber 5. The opening 13 of the liquid chamber 5 is disposed in the rear surface of the liquid chamber 5 and has a trapezoid or rectangular shape as shown in FIG. 14B. The opening 13 must have a height nearly equal to that of the liquid chamber 5 in order to reserve a sufficient sectional area without narrowing an ink flow path. Accordingly, the ink flow 12 which flows from the opening 13 into the liquid chamber 5 at the suction recovery time has a portion of a maximum flow velocity in the vicinity of a center of the opening 13 as shown in FIG. 14D and other portions of flow velocities which are slowed down outward.

Even after the above described sucking operation is performed, bubbles 14-1 and 14-2 may adhere to the ceiling surface of the liquid chamber 5 and remain as shown in FIGS. 14A, 14B, 14C and 14D.

The remaining bubble 14 may gradually expand due to a temperature rise in the ink jet cartridge due to successive printing operations and incorporation with fine bubbles coming from a side of the ink tank, thereafter leaving from a wall surface of the liquid chamber 5, reaching the flow path 4 and filling the flow path 4, thereby disabling the ink jet cartridge from discharging the ink.

Furthermore, the background art may allow the liquid chamber 5 to be filled with the bubble and disable all the flow paths from discharging the ink, thereby posing a problem in image qualities.

Though means for enhancing a sucking pressure of the ink jet recording apparatus main unit can be considered as a method to remove the bubble from the liquid chamber 5, it is difficult to enhance the sucking pressure simply since a sucking pressure which is higher than required produces a turbulent flow in the ink supply path from the ink tank to the ink discharge unit at the suction recovery time, thereby producing small bubbles due to a cavitation phenomenon contrary to a purpose.

SUMMARY OF THE INVENTION

The present invention has been achieved in view of the problems of the conventional art and has an object to provide an ink jet recording head which is capable of removing a bubble stagnant in a liquid chamber without enhancing a sucking pressure and an ink jet recording apparatus which uses the ink jet recording head.

In order to accomplish the above described object, an ink jet recording head according to the present invention is an ink jet recording head comprising a discharge port for discharging ink, a liquid flow path which communicates with the discharge port and in which a heat energy generating element for generating a heat energy to be utilized for discharging ink is disposed, a common liquid chamber which is disposed for supplying ink into the above described liquid flow path as the ink is discharged and located after the above described liquid flow path, and an ink supply port for supplying ink into the above described common liquid chamber, characterized in that the above described common liquid chamber has a curved surface convex inward of the above described liquid chamber in a region adjacent to the above described ink supply port.

Furthermore, an ink jet recording head in another mode of the present invention is an ink jet recording head comprising a substrate on which a plurality of energy generating elements for generating a discharging energy are disposed, and a ceiling plate which integrally forms a concavity having grooves composing a plurality of liquid flow paths corresponding to a plurality of discharge ports for discharging ink respectively and a common liquid chamber that communicates with the above described grooves respectively for supplying the ink to the above described plurality of liquid flow paths, and an ink supply port and is joined to the above described substrate, characterized in that the concavity of the above described ceiling plate has a curved surface which is convex toward the above described substrate in a region between the above described grooves and the above described ink supply ports.

Furthermore, an ink jet recording apparatus according to the present invention is characterized in that it comprises a carriage on which the above described ink jet recording head is mounted and performs recording on a recording medium by sliding the above described carriage on the recording medium.

Since a ceiling of a liquid chamber which holds the ink discharged from the discharge port has a curved surface convex inward in the ink jet recording head according to the present invention configured as described above, the liquid chamber has a region where its sectional area is smoothly narrowed to a location at which a bubble is stagnant in a flow direction of the ink from the ink supply port toward the ink discharge port and then smoothly enlarged. Accordingly, the ink jet recording head allows the ink to flow at a flow velocity not slowed down in the vicinity of the ceiling surface when suction recovery is performed from the discharge port, thereby exhibiting enhanced performance for removing a bubble which adheres to a surface of the ceiling.

When a maximum area of a section of the common liquid chamber perpendicular to the substrate is not larger than 2.5 times of an opening of the ink supply port, a reduction of a flow velocity of the ink introduced from the supply path into the liquid chamber is minimized at the time of suction recovery operation, thereby enhancing the performance for removing the bubble.

When a region in which a sectional area is enlarged toward the liquid chamber is reserved in the flow path at a location of communicating with the liquid chamber, the ink flows smoothly upstream of the flow path, thereby preventing a bubble from remaining in the vicinity of an upstream section of the flow path.

In addition, a form of the common liquid chamber according to the present invention wherein the ink supply port is located in a region opposed to the discharge port as described above exhibits a remarkable effect to permit removing a bubble more easily.

BRIEF DESCRIPTION OF THE DRAWINGS

FIG. 2A being a sectional view of the vicinity of the liquid chamber taken in the direction of the flow path, FIG. 2B being a view of the liquid chamber as seen from a side of a discharge port, FIG. 2C being a top view of the liquid chamber and FIG. 2D being a side view of the liquid chamber;

FIG. 6A being a view of a liquid chamber as seen from a side of a discharge port, FIG. 6B being a top view of the liquid chamber and FIG. 6C being a side view of the liquid chamber;

FIG. 12A being a view as seen from a side of a discharge port, FIG. 12B being a top view and FIG. 12C being a side view;

FIG. 14A being a sectional view taken in a direction of a flow path of the ink jet cartridge, FIG. 14B being a view of a liquid chamber as seen from a side of a discharge port, FIG. 14C being a top view of the liquid chamber and FIG. 14D being a side view of the liquid chamber;

DETAILED DESCRIPTION OF THE PREFERRED EMBODIMENTS

Now, the preferred embodiments of the present invention will be described in detail with reference to the accompanying drawings.

Figure 1:
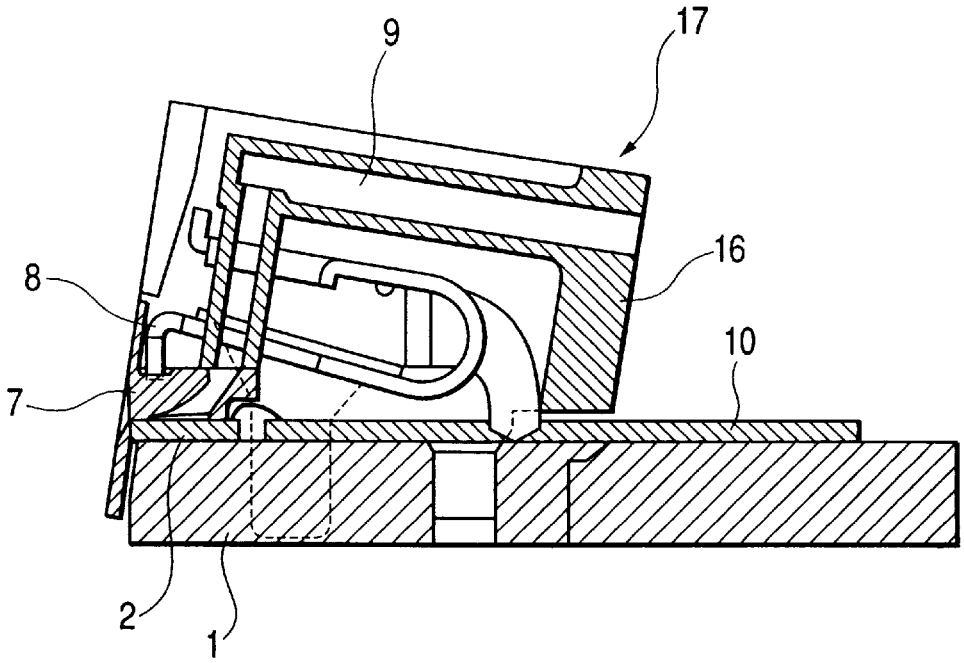
FIG. 1 is a sectional view taken in a direction of a flow path showing an embodiment of an ink discharge unit to be used in an ink jet cartridge according to the present invention.
Figure 2A:
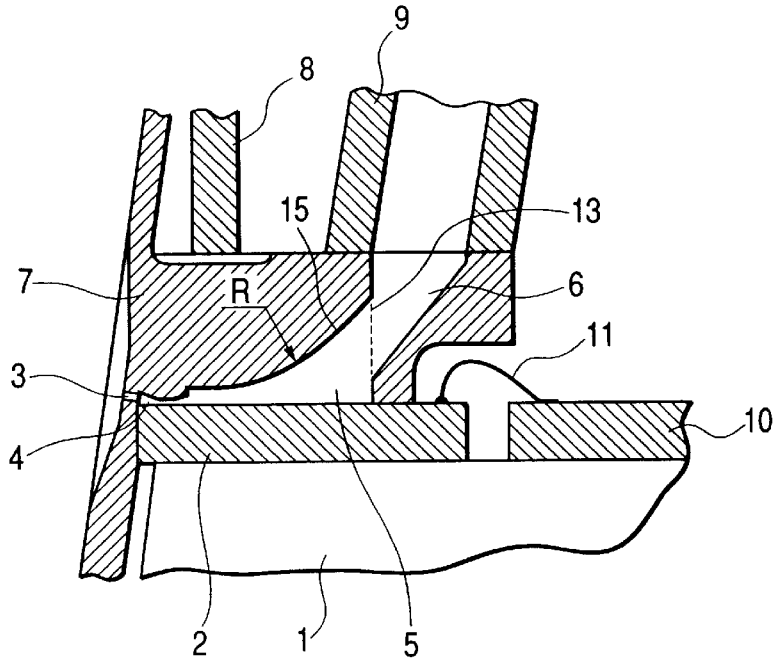
FIGS. 2A, 2B, 2C and 2D are diagrams illustrating in detail a vicinity of a liquid chamber shown in FIG. 1.
Figure 2B:
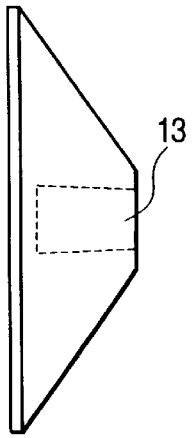
Figure 2C:
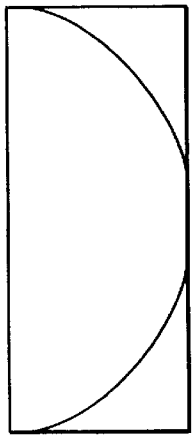
Figure 2D:
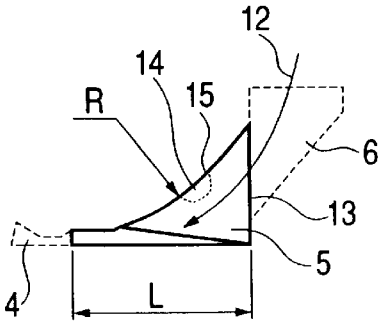

FIG. 1 is a sectional view taken in a direction of a flow path showing an embodiment of an ink discharge unit which is to be used in the ink jet cartridge according to the present invention. Furthermore, FIGS. 2A, 2B, 2C and 2D are diagrams illustrating in detail a vicinity of a liquid chamber shown in FIG. 1: FIG. 2A being a sectional view of the vicinity of the liquid chamber taken in the direction of the flow path. FIG. 2B being a view of the liquid chamber as seen from a side of a discharge port, FIG. 2C being a top view of the liquid chamber and FIG. 2D being a side view of the liquid chamber.

The embodiment is configured by a base plate 1 which is made of a metal such as aluminum, a heater board 2 which is disposed on the base plate 1 and composed of a silicon substrate or the like on which heater array is arranged for discharging ink, a printed wiring board 10 for transmitting an electric signal to the heater array on the heater board 2 by way of a bonding wire 11, a plurality of discharge ports 3 which discharge ink, a plurality of flow paths 4 which communicate with the plurality of discharge ports 3 for supplying the ink to the discharge ports 3, a liquid chamber 5 which communicates with the flow paths 4 for holding the ink supplied to the flow paths 4, a supply path 6 which communicates with an ink tank (not shown) for supplying the ink from the ink tank to the liquid chamber 5, a supply tube 9 which forms the supply path 6, a grooved ceiling plate 7 which integrally forms the flow paths 4, the liquid chamber 5 and a portion of the supply path 6, and a clamp spring 8 which fixes the grooved ceiling plate 7: the discharge ports 3 being formed by a laser boring method after the flow paths 4, the liquid chamber 5 and the portion of the supply path 6 are formed in the grooved ceiling plate 7 by plastic molding. Furthermore, the liquid chamber 5 communicates with the supply path 6 by an opening 13 and the ink is supplied from the ink tank into the liquid chamber 5 by way of the opening 13, as shown in FIGS. 1, 2A, 2B, 2C and 2D.

This embodiment is characterized in that a ceiling surface of the liquid chamber 5 opposed to the heater board 2 is configured as a curved surface which extends in a direction perpendicular to the paper surface and has a radius R.

Description will be made below of a series of operations from ink discharge to suction of the ink jet cartridge which uses the ink discharge unit configured as described above.

FIGS. 3A, 3B, 3C and 3D are diagrams descriptive of the series of operations from the ink discharge to the suction of the ink jet cartridge which uses the ink discharge unit shown in FIGS. 1, 2A, 2B, 2C and 2D.

Figure 3A:
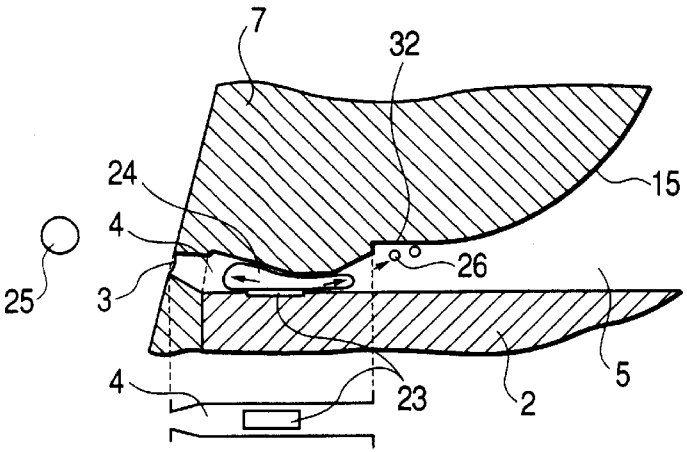
FIGS. 3A, 3B, 3C and 3D are diagrams descriptive of a series of operations from ink discharge to suction in an ink jet cartridge which uses the ink discharge unit shown in FIGS. 1, 2A, 2B, 2C and 2D.

When a heater 23 on the heater board 2 generates heat on the basis of the electric signal transmitted from the printed wiring board 10, ink is heated and boiled by the heat in the flow path 4, thereby producing a bubble 24 on the heater 23. The ink in the flow path 4 is discharged from the discharge port 3 under a pressure produced by the bubble 24 (FIG. 3A). At this time, a small number of small bubbles 26 may be produced upstream of the flow path 4.

Figure 3B:
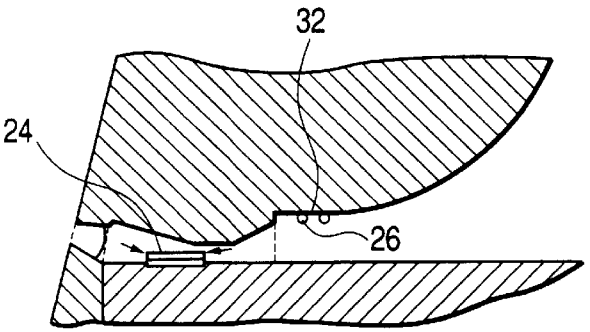

The small bubbles 26 which are produced upstream of the flow path 4 are stagnant in the liquid chamber 5 even after the bubble 24 on the heater 23 disappears (FIG. 3B).

Figure 3C:
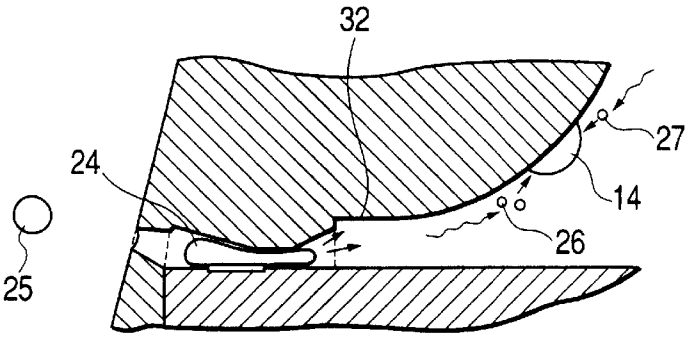

When the heater 23 on the heater board 2 subsequently generates heat once again on the basis of the electric signal transmitted from the printed wiring board 10, the ink in the flow path 4 is heated and boiled by the heat and the bubble 24 is produced on the heater 23, but the small bubbles 26 move upstream of the liquid chamber 5 under a pressure produced by the bubble 24 and adhere to the ceiling surface of the liquid chamber 5 together with a small bubble 27 coming from the supply path 6, thereby forming a bubble 14 (FIG. 3C).

Figure 3D:
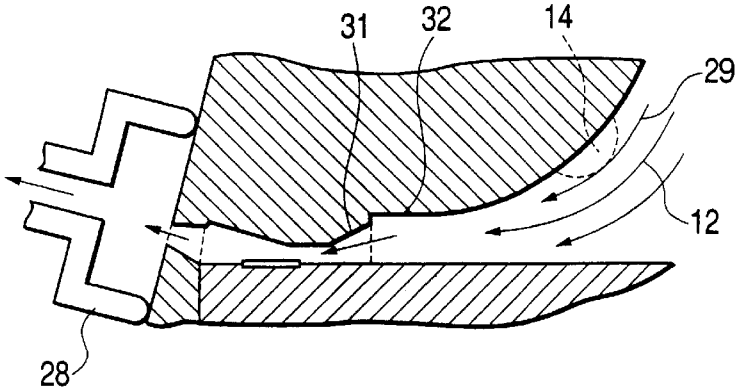

When suction recovery is performed at this time by bringing a suction pad 28 into contact with a surface of the discharge port 3 and sucking the ink from the flow path 4 as shown in FIG. 3D, the ink flows in the liquid chamber 5 as indicated by an arrow of an ink flow 12 and an ink flow velocity is high enough to remove a bubble even in the vicinity of the ceiling surface where a sectional area of the liquid chamber is smoothly narrowed and the bubble 14 is adhering.

In other words, the present invention brings a location of the bubble adhering to the ceiling surface of the liquid chamber nearer the ink flow 12 which has a maximum flow velocity as shown in FIG. 3D, thereby making it possible to obtain a sufficient flow velocity for an ink flow 29 which removes the bubble 14.

Accordingly, the bubble 14 which adheres to the ceiling surface of the liquid chamber 5 is easily removed by this sucking operation.

Furthermore, this embodiment smooths an ink flow upstream of the flow path 4 and allows no bubble to remain upstream the flow path 4 since the flow path 4 has a region 31 where a sectional area of the flow path 4 is enlarged toward an ink supply side upstream of the flow path 4.

Furthermore, the ink flow 12 is drawn smoothly into the flow path 4 at a time of the suction recovery since a horizontal section 32 is smoothly continuous to the liquid chamber 5 in FIG. 3D. Accordingly, ink discharge unit allows the small bubbles 26 not to be caught in the vicinity of the horizontal section 32 at the time of the suction recovery, thereby allowing no bubble to remain in the liquid chamber 5. Since a sectional area of an ink flow path changes continuously and slightly from the curved surface and the horizontal section 32 of the liquid chamber 5 to the region 31 where the sectional area is enlarged at a rear end of the flow path, the flow path 4 and the discharge port 3, the ink flows smoothly at the time of the suction recovery, a turbulent flow is hardly produced and a bubble removing property is favorable or no bubble is produced.

By configuring the ceiling surface of the liquid chamber 5 which is opposed to the heater board 2 as a curved surface 15 as described above, after sucking operation is performed, it is possible to flow the ink from the supply path 6 smoothly along the curved surface 15 of the liquid chamber 5 and not to slow down a flow velocity in the vicinity of the curved surface 15, or the ceiling surface of the liquid chamber 5 to which a bubble is apt to adhere, thereby enhancing bubble removing performance.

The inventor et al. have found that sufficient bubble removing performance can be obtained by configuring the curved surface 15 so as to have a radius of curvature R which is not longer than 1.5 times of a length L of the liquid chamber 5.

Furthermore, it is desirable that the radius of curvature is shorter than the length L since the liquid chamber 5 has a small height and a small sectional area in the vicinity of the flow path 4, thereby making resistance of the flow path too high and degrading performance to supply ink into the flow path 4 when the radius of curvature is not shorter than the length L.

Furthermore, a similar effect can be obtained when the curved surface 15 is configured so as to have a polygonal shape or a finely stepped shape for convenience of molding die working.

A surface which is substantially a curved surface will therefore be regarded as a curved surface in the present invention.

Figure 4:
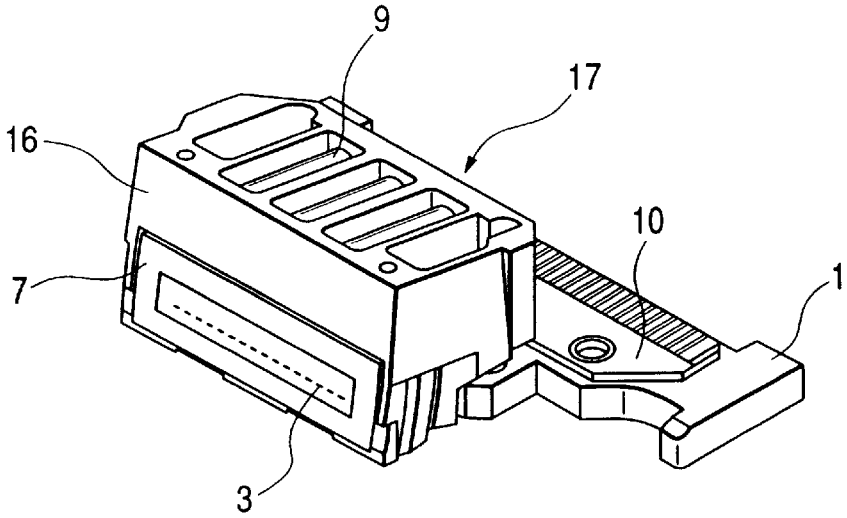
FIG. 4 is a perspective view showing an appearance of the ink discharge unit shown in FIGS. 1, 2A, 2B, 2C and 2D.

FIG. 4 is a perspective view showing an appearance of the ink discharge unit shown in FIGS. 1, 2A, 2B, 2C and 2D, and FIG. 5 is a perspective view showing an appearance of the ink jet cartridge which uses the ink discharge unit shown in FIG. 4.

Figure 5:
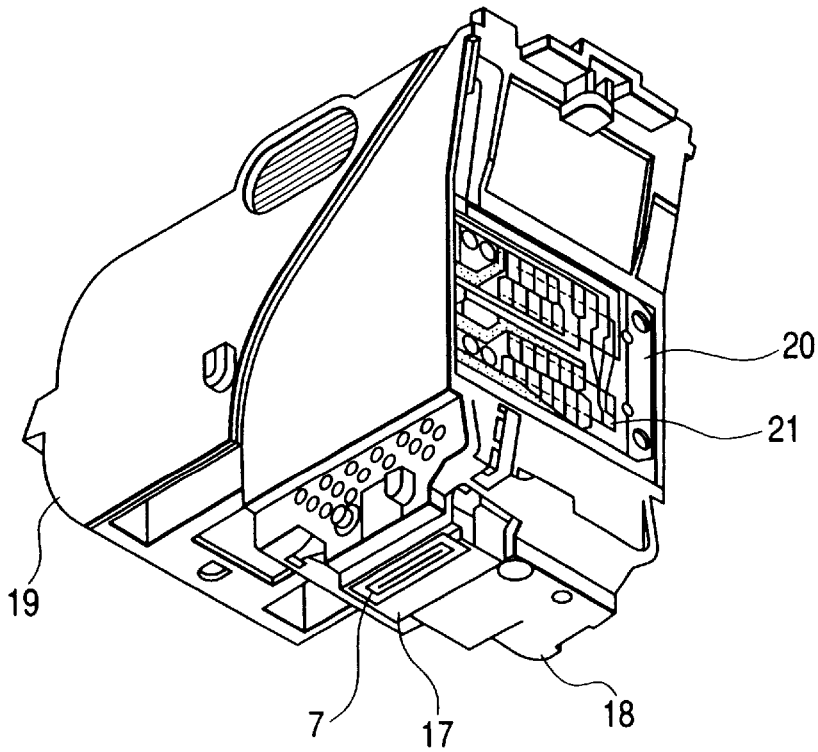
FIG. 5 is a perspective view showing an appearance of an ink jet cartridge which uses the ink discharge unit shown in FIG. 4.

The ink discharge unit 17 shown in FIG. 4 is attached to a holding member 18 and the holding member 18 is coupled with an ink tank holder 19 as shown in FIG. 5 so that ink is supplied from an ink tank attached to the ink tank holder 19 into an ink discharge unit 17.

A printed wiring board 10 of the ink discharge unit 17 is connected to a flexible wiring board 20 and receives an electric signal from an ink jet recording apparatus main unit by way of a contact pad 21 on the flexible wiring board 20.

Referring to FIGS. 15, 16, 17A and 17B, description will be made of a configuration of a common liquid chamber according to the present invention and a location of an ink supply port disposed in the common liquid chamber.

Figure 10:
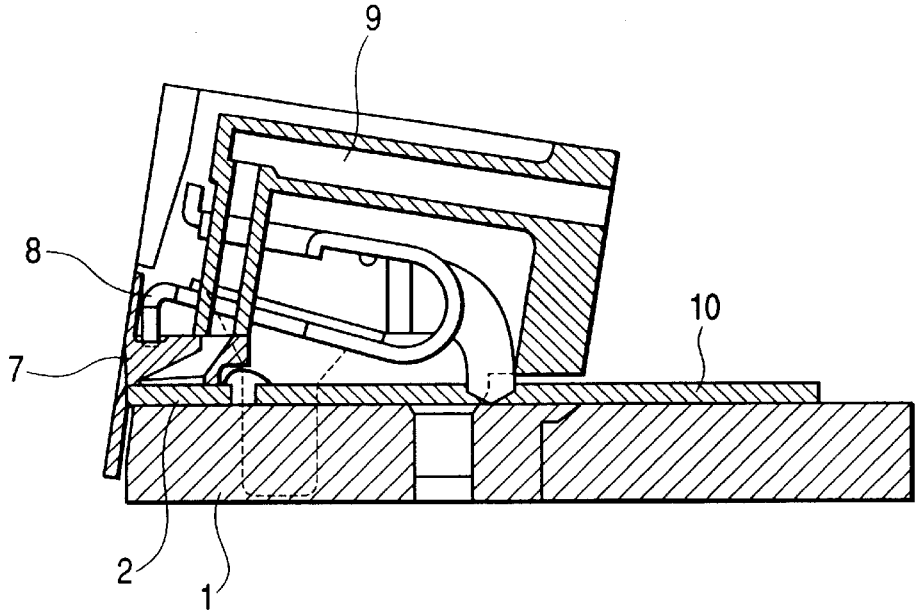
FIG. 10 is a sectional view taken in a direction of a flow path showing a configurational example of an ink discharge unit which constitutes a background art of the present invention.
Figure 11:
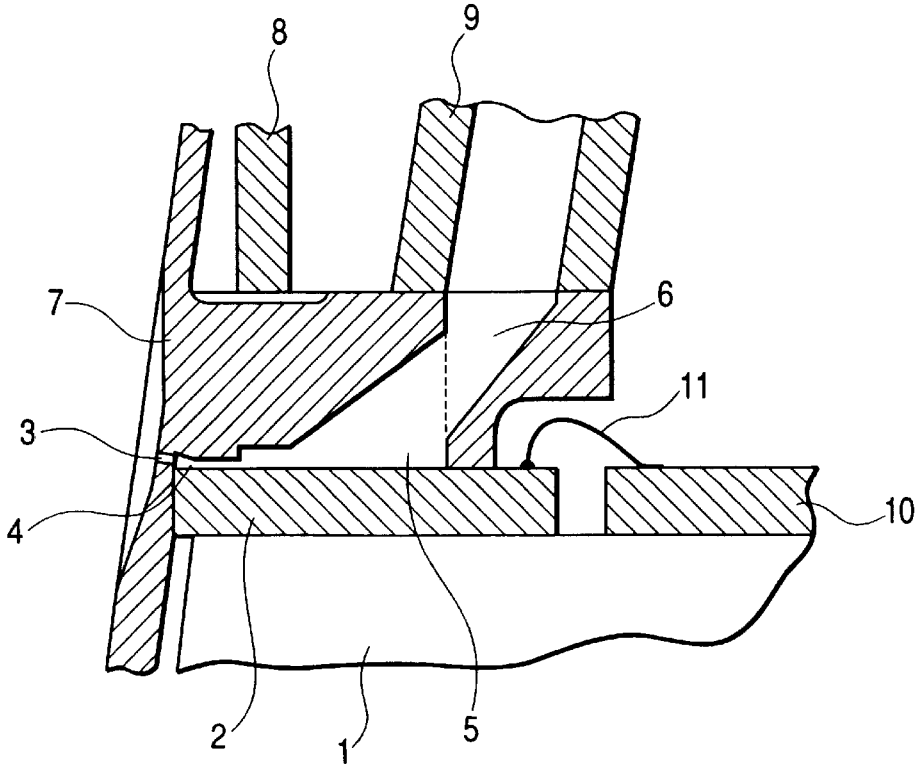
FIG. 11 is an enlarge view of a vicinity of a liquid chamber shown in FIG. 10.
Figure 12A:
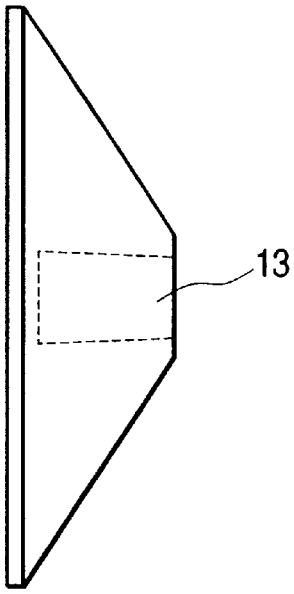
FIGS. 12A, 12B and 12C are diagrams showing a form of the liquid chamber shown in FIG. 10.
Figure 12B:
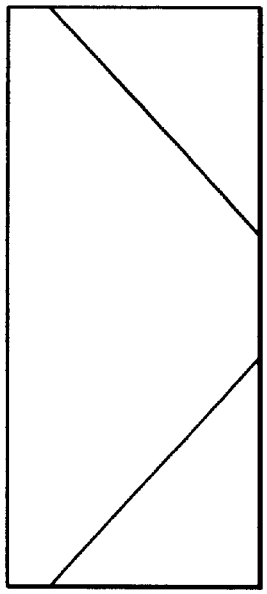
Figure 12C:
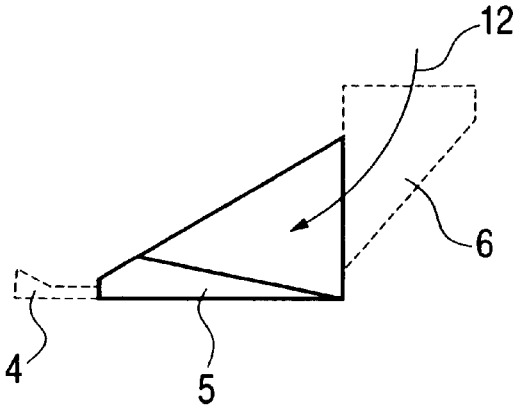
Figure 13C:
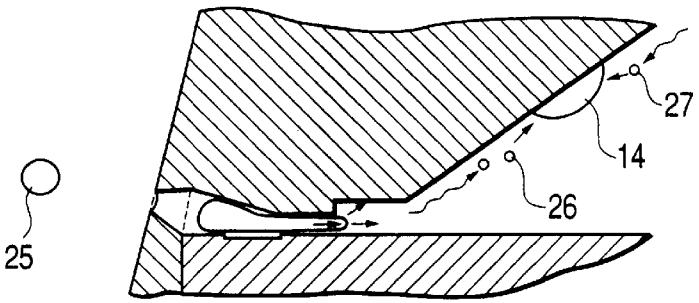
FIGS. 13A, 13B, 13C and 13D are diagrams descriptive of a series of operations from ink discharge to suction in an ink jet cartridge which uses the ink discharge unit shown in FIG. 10.
Figure 13D:
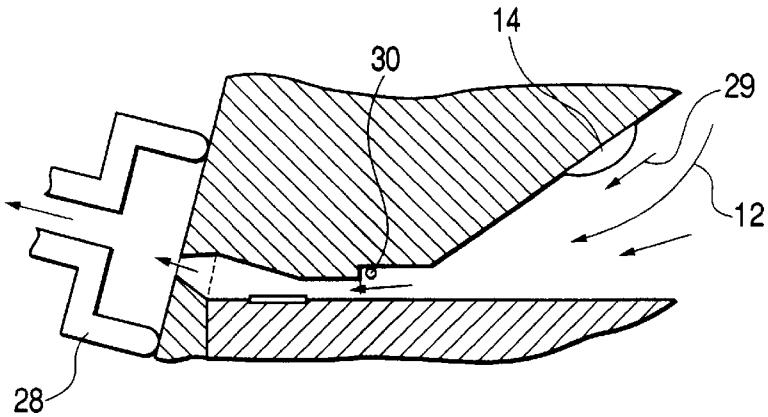
Figure 13A:
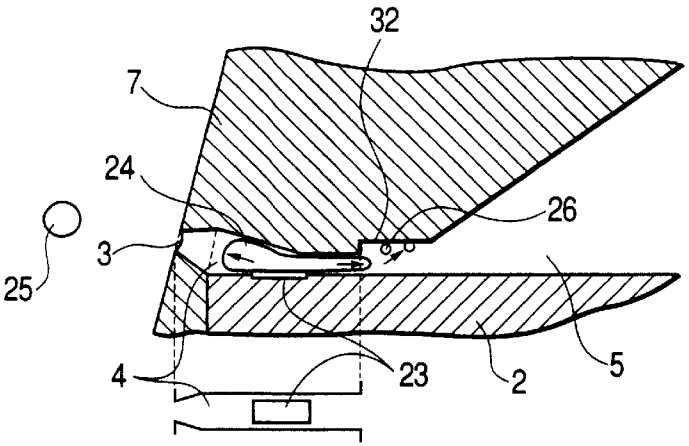
Figure 13B:
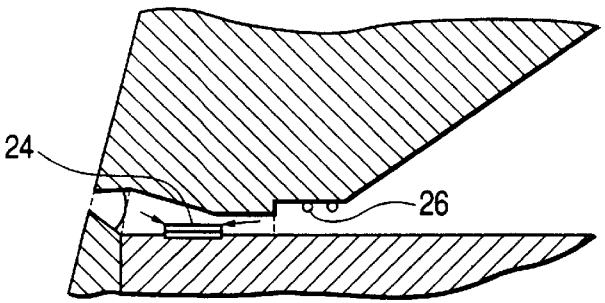
Figure 14A:
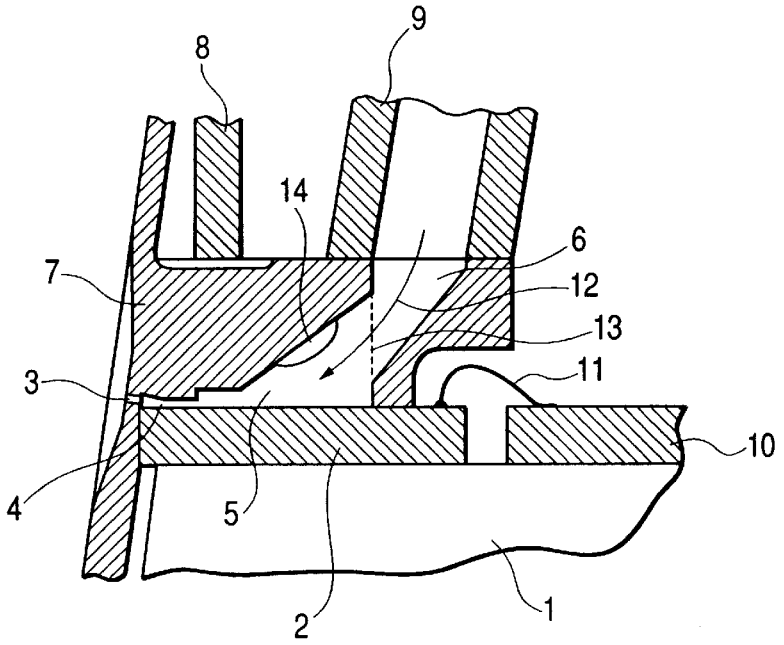
FIGS. 14A, 14B, 14C and 14D are diagrams descriptive in detail of a bubble remaining after the operations shown in FIGS. 13A, 13B, 13C and 13D.
Figure 14B:
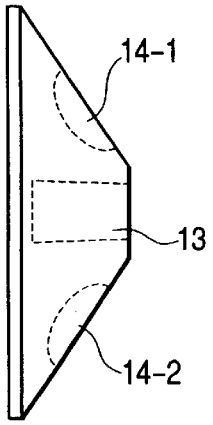
Figure 14C:
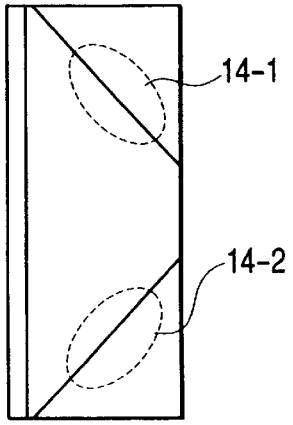
Figure 14D:
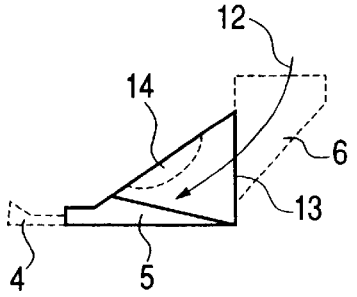
Figure 15:
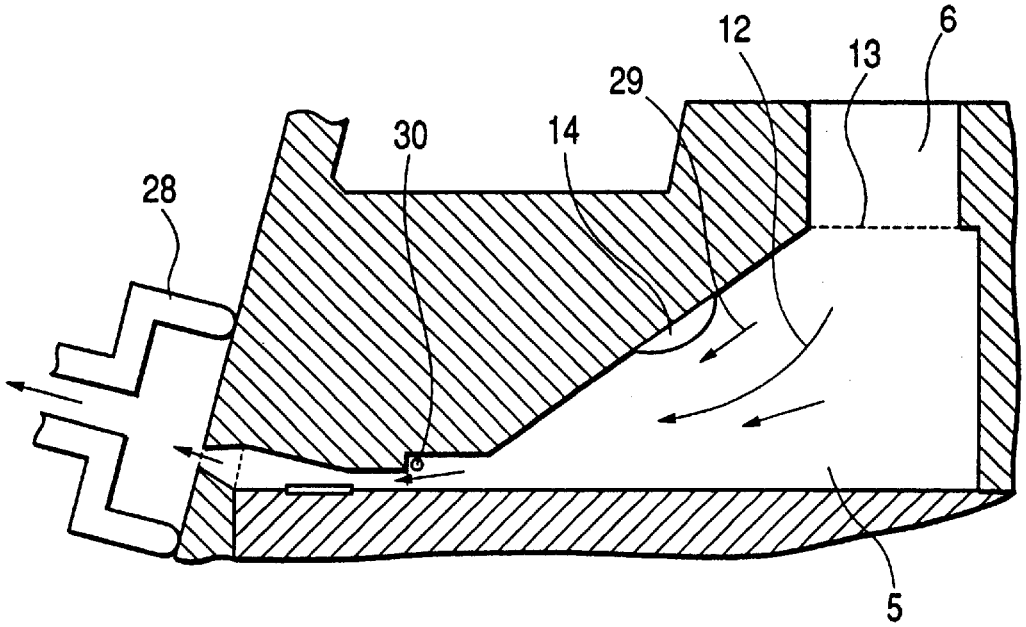
PRIOR ART FIG. 15
FIG. 15 is a sectional view taken in a direction of a flow path showing a configurational example of a vicinity of a liquid chamber in an ink discharge unit used in a conventional ink jet cartridge.

FIG. 15 is a sectional view showing a configurational example of a conventional type liquid chamber shown in FIG. 10 or the like. Different from the above described background art shown in FIG. 10, this conventional example has a configuration wherein an opening 13 that communicates with a supply path 6 is disposed in a ceiling surface of a liquid chamber 5.

In case of the configuration of the conventional type liquid chamber shown in FIG. 15 wherein sectional areas of ink flows are abruptly enlarged, velocities of ink flows 12 and 29 are lowered in the liquid chamber 5 when ink flows into the liquid chamber 5 by way of the opening 13 at a time of the suction recovery. Furthermore, the configuration of the conventional type liquid chamber makes it difficult to remove a bubble 14 in a certain case since the ink flow 12 which has a maximum flow velocity is far from a bubble 14 to be removed which is adhering to a slant surface of the liquid chamber.

Figure 16:
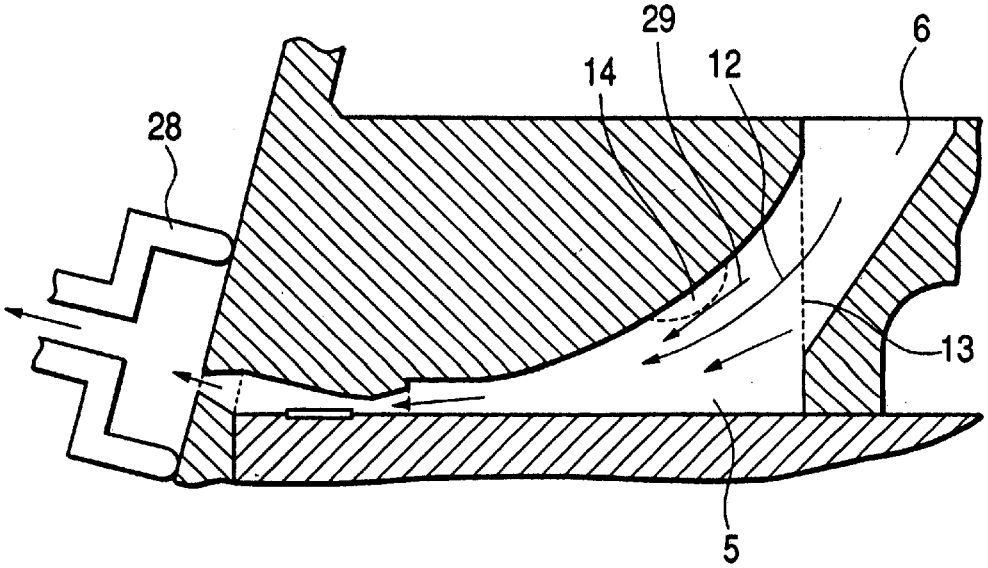
FIG. 16 is a sectional view taken in a direction along a flow path showing an embodiment of a vicinity of a liquid chamber in an ink discharge unit to be used in the ink jet cartridge according to the present invention.

In a configuration of a liquid chamber according to the present invention shown in FIG. 16, in contrast, an opening 13 that communicates with a supply port 6 is formed in a rear side surface of a liquid chamber 5, that is, in a region of the liquid chamber which is opposed to a discharge port and the opening is disposed at a location adjacent to a curved surface which is convex inward of the liquid chamber.

Accordingly, the configuration of the liquid chamber according to the present invention allows sectional areas of ink flows to be enlarged less than the sectional areas of the ink flows in the conventional type liquid chamber shown in FIG. 15 when ink flows into the liquid chamber 5 by way of the opening 13 at the time of the suction recovery, whereby flow velocities of the ink flows 12 and 29 are less lowered. Furthermore, the configuration of the liquid chamber according to the present invention brings the ink flow 12 having the maximum flow velocity nearer the bubble 14 to be removed which is adhering to the slant surface of the liquid chamber than the ink flow 12 in the conventional example shown in FIG. 15, thereby making it possible to remove the bubble with a slight suction recovery operation.

Figure 17A:
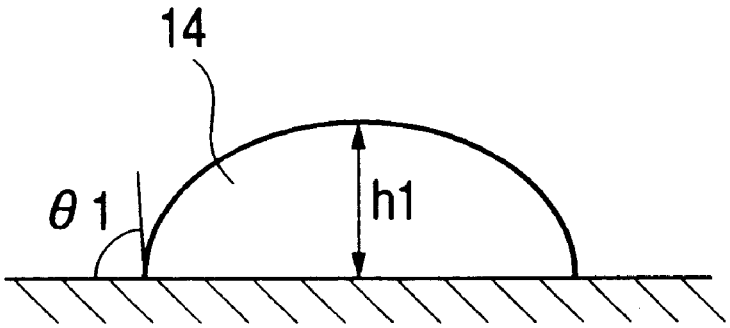
FIGS. 17A and 17B are diagrams descriptive of a bubble adhering to a wall surface.
Figure 17B:
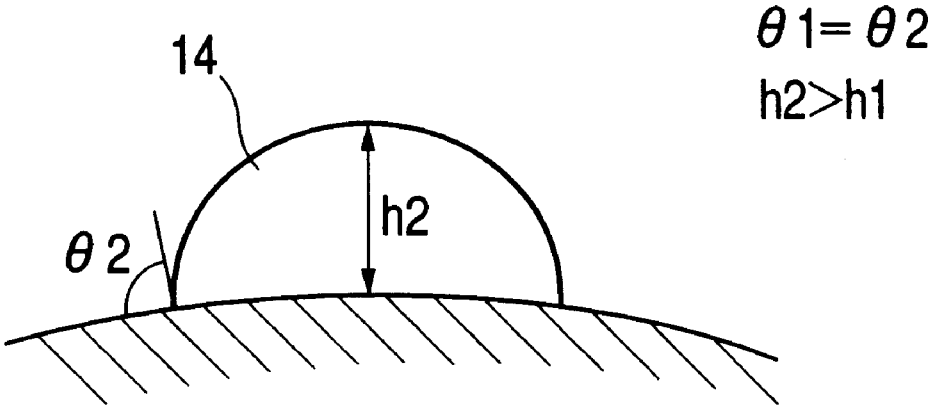

Comparing a bubble which is adhering to a flat slant surface shown in FIG. 15 with a bubble which is adhering to a curved surface shown in FIG. 16, a height h2 of the bubble adhering to the curved surface shown in FIG. 17B is larger than a height h1 of the bubble adhering to the flat surface shown in FIG. 17A when the bubbles have an identical volume since ink contact angles θ1 and θ2 are equal to each other as shown in FIGS. 17A and 17B so far as the wall surfaces of the liquid chambers are made of an identical material. Since the bubble having the larger height is removed more easily by an ink flow at the time of the above described suction recovery, a form of the liquid chamber according to the present invention allows a bubble to be removed more easily.

The form of the common liquid chamber according to the present invention wherein the ink supply port is located in a region opposed to the discharge port as described above exhibits a remarkable effect to permit removing a bubble more easily.

(Other Embodiments)

Figure 6A:
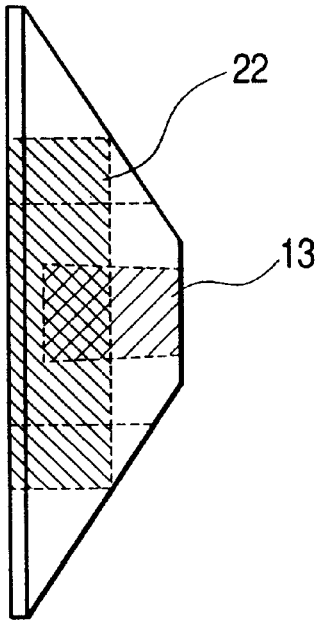
FIGS. 6A, 6B and 6C are diagrams showing another embodiment of the ink jet cartridge according to the present invention.
Figure 6B:
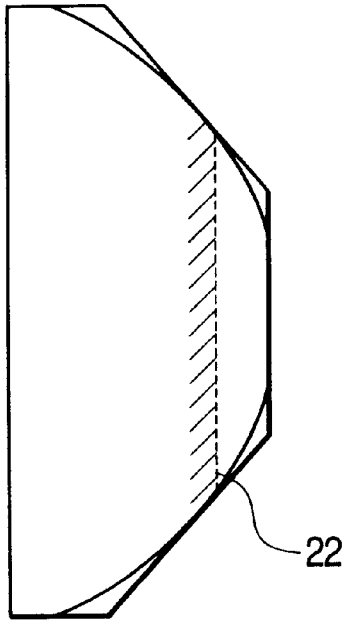
Figure 6C:
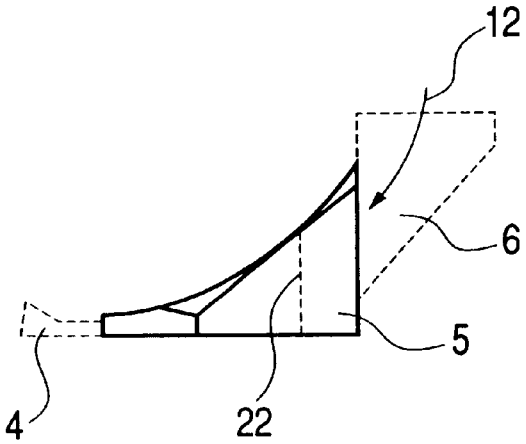

FIGS. 6A, 6B and 6C are diagrams showing another embodiment of the ink jet cartridge according to the present invention: FIG. 6A being a view of a liquid chamber as seen from a side of a discharge port, FIG. 6B being a top view of the liquid chamber and FIG. 6C being a side view of the liquid chamber.

The liquid chamber used in this embodiment has a form similar to the form of the liquid chamber 5 shown in FIGS. 2A, 2B, 2C and 2D from which two angle portions are cut off on a side of the supply port 6 as shown in FIGS. 6A, 6B and 6C.

Accordingly, this embodiment narrows a region of a wall surface to which a bubble is liable to adhere and is capable of further reducing a size of a remaining bubble.

Furthermore, the liquid chamber shown in FIGS. 6A, 6B and 6C has a sectional area which is smaller than that of the liquid chamber shown in FIGS. 2A, 2B, 2C and 2D. Though the ink jet cartridge shown in FIGS. 2A, 2B, 2C and 2D lowers the velocity of the ink flow 12 when it enters the liquid chamber 5 from the supply path 6 due to enlargement from a sectional area of the supply path 6 to the sectional area of the liquid chamber 5, the embodiment narrows the sectional area and is capable of lessening a reduction of the flow velocity of the ink flow when the ink flows from the supply path 6 into the liquid chamber 5.

Speaking of a relation between an area of the opening 13 by which the supply path 6 communicates with the liquid chamber 5 and an area of a maximum section 22 of the liquid chamber 5 (an imaginary surface in the liquid chamber 5 intersecting the ink flows in the liquid chamber 5 which is practically defined as a sectional surface in a direction perpendicular to the surface of the heater board 2 (a perpendicular surface along the length L of the liquid chamber) whichever has a largest area), the inventor et al. have found that a flow velocity of the ink flow 12 which is required for removing a bubble throughout the liquid chamber 5 can be obtained when the area of the maximum section 22 of the liquid chamber 5 is not larger than 2.5 times of the area of the opening 13.

Now, description will be made of an ink jet recording apparatus which uses the ink jet cartridge described above.

Figure 7:
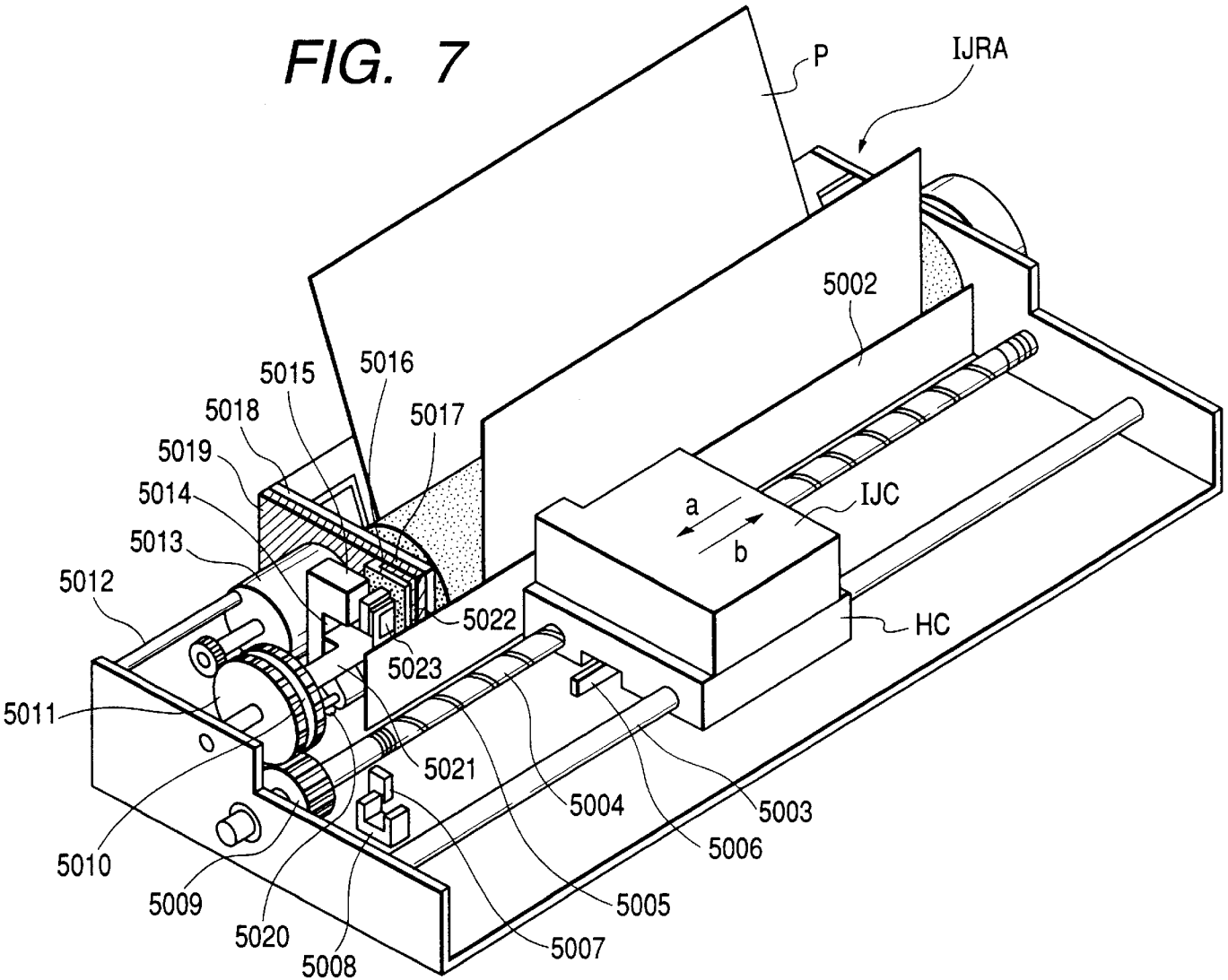
FIG. 7 is a general view of an ink jet recording apparatus which uses the ink jet cartridge according to the present invention.

FIG. 7 is a general view of an ink jet recording apparatus IJRA which uses the ink jet cartridge according to the present invention.

An ink jet cartridge IJC which incorporates a recording head with an ink tank is mounted on a carriage HC as shown in FIG. 7 and performs recording on a recording medium P while reciprocally moving together with the carriage HC in directions indicated by arrows a and b. Furthermore, the carriage HC has a pin (not shown) which is disposed so as to be engaged with a spiral groove 5005 formed in a lead screw 5004 and when a driving motor 5013 rotates (normally or reversely), its rotation is transmitted to the lead screw 5004 by way of a driving force transmission gears 5011 and 5009, whereby the lead screw 5004 is rotated and the carriage reciprocally moves along a guide shaft 5003 in the directions indicated by the arrows a and b.

Furthermore, there is provided a paper clamp plate 5002 which presses the recording medium P to a platen along a moving direction of the carriage HC.

Furthermore, photocouplers 5007 and 5008 are disposed as means for detecting a home position of the carriage HC which confirms presence of a lever 5006 disposed under the carriage HC in this region to switch a rotating direction of the motor 5013 and so on.

Furthermore, disposed as recovery means for the recording head are a cap member 5022 for capping a front surface of the recording head, a member 5016 for supporting the cap member 5022, a suction member 5015 for sucking an interior of the cap member 5022, a cleaning blade 5017 which is supported by a main unit supporting plate 5018 for cleaning the front surface of the recording head, and a member 5019 which is supported by the main unit supporting plate 5018 for making the cleaning blade 5017 movable in forward and backward directions, and the suction recovery of the recording head is performed by way of an opening 5023 in a cap. It is needless to say that the cleaning blade may not be of this type and a known cleaning blade is applicable to the embodiment. Furthermore, a lever 5012 which is provided to start suction of the suction recovery is moved as a cam 5020 engaged with the carriage HC moves and controlled by known transmission means such as a clutch which switches a driving force from the driving motor 5013.

Though the lead screw 5004 is configured to perform treatments required for the capping, cleaning and suction recovery at locations corresponding to the operating members when the carriage HC is positioned within a region of the home position, and any lead screw which performs required operations at known timings is applicable to the embodiment.

Though the ink jet recording apparatus which uses the cartridge type recording head incorporated with the ink tank has been described above, an ink jet recording apparatus of a type which supplies ink from an ink tank to a recording head through a remarkably thin tube is also included within a scope of the present invention.

Figure 8:
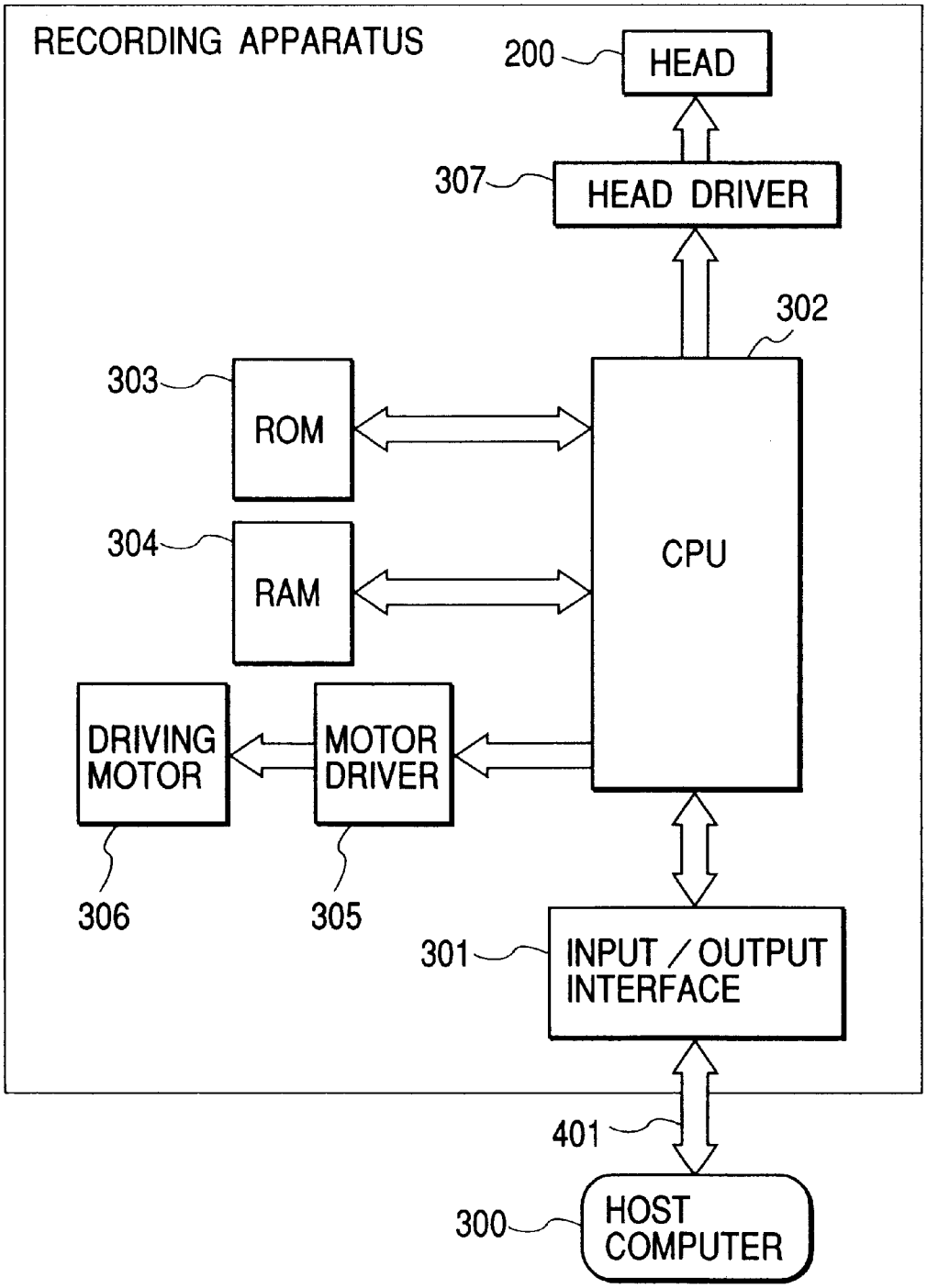
FIG. 8 is a block diagram showing a configurational example of the ink jet recording apparatus which uses the ink jet cartridge according to the present invention.

FIG. 8 is a block diagram showing a configurational example of an ink jet recording apparatus which uses the ink jet cartridge according to the present invention.

As shown in FIG. 8, the ink jet recording apparatus is configured by an input/output interface 301 which transmits and receives data 401 to and from a host computer 300, a ROM 303 which stores a control program, a driving motor 306 which moves a recording medium and a recording head, a CPU 302 which converts data input by way of the input/output interface 301 into data to be printed (image data) by processing the data on the basis of the control program stored in the ROM 303 and generates driving data for driving the driving motor 306 in synchronization with the image data, a RAM 304 which is used for data processing in the CPU 302, a motor driver 305 which drives the driving motor 306 on the basis of the driving data generated by the CPU 302, and a head driver 307 which drives a head 200 for printing on the basis of the image data converted by the CPU 302.

When print data is input as a control signal from the host computer 300 into the ink jet recording apparatus which is configured as described above, the print data is temporarily stored in the input/output interface 301, and simultaneously converted into data which is processable in the recording apparatus and input into the CPU 302 which serves also as head driving signal supply means.

In the CPU 302, the data input in the CPU 302 is processed on the basis of the control program stored in the ROM 303 using peripheral units such as the RAM 304 and converted into the data to be printed (image data).

Furthermore, generated in the CPU 302 is driving data for driving the driving motor 306 which moves the recording apparatus and the recording head in synchronization with the image data for recording the image data at an adequate location on the recording medium.

The image data and the driving data are transferred to the head 200 and the driving motor 306 by way of the head driver 307 and the motor driver 305, which are driven at controlled timings respectively for forming an image.

As recording media which are applicable to the recording apparatus described above for printing with liquids such as ink, there can be mentioned various kinds of paper and OHP sheets, compact disks, plastic materials used as decorative plates and the like, cloth, metal materials such as aluminium and copper, leather materials such as cowhide, pigskin and artificial leather, wood materials such as timbers and plywood, bamboo materials, ceramic materials such as tiles and three-dimensional structures such as sponge.

Furthermore, the above described recording apparatus includes a printer apparatus for recording on various kinds of paper and OHP sheets, a recording apparatus for plastic which performs recording on plastic materials such as a compact disk, a recording apparatus for metal which performs recording on metal plates, a recording apparatus for leather which performs recording on leather materials, a recording apparatus for wood which performs recording on wood materials, a recording apparatus for ceramic which performs recording on ceramic materials, a recording apparatus for recording on three-dimensional web structures such as sponge and a printing apparatus which performs recording on cloth and the like.

Discharge liquids which are matched with recording media and recording conditions are to be adopted for these liquid discharge apparatuses.

Description will be made below of an example of ink jet recording system which performs recording on a recording medium using the ink jet cartridge according to the present invention as a recording head.

Figure 9:
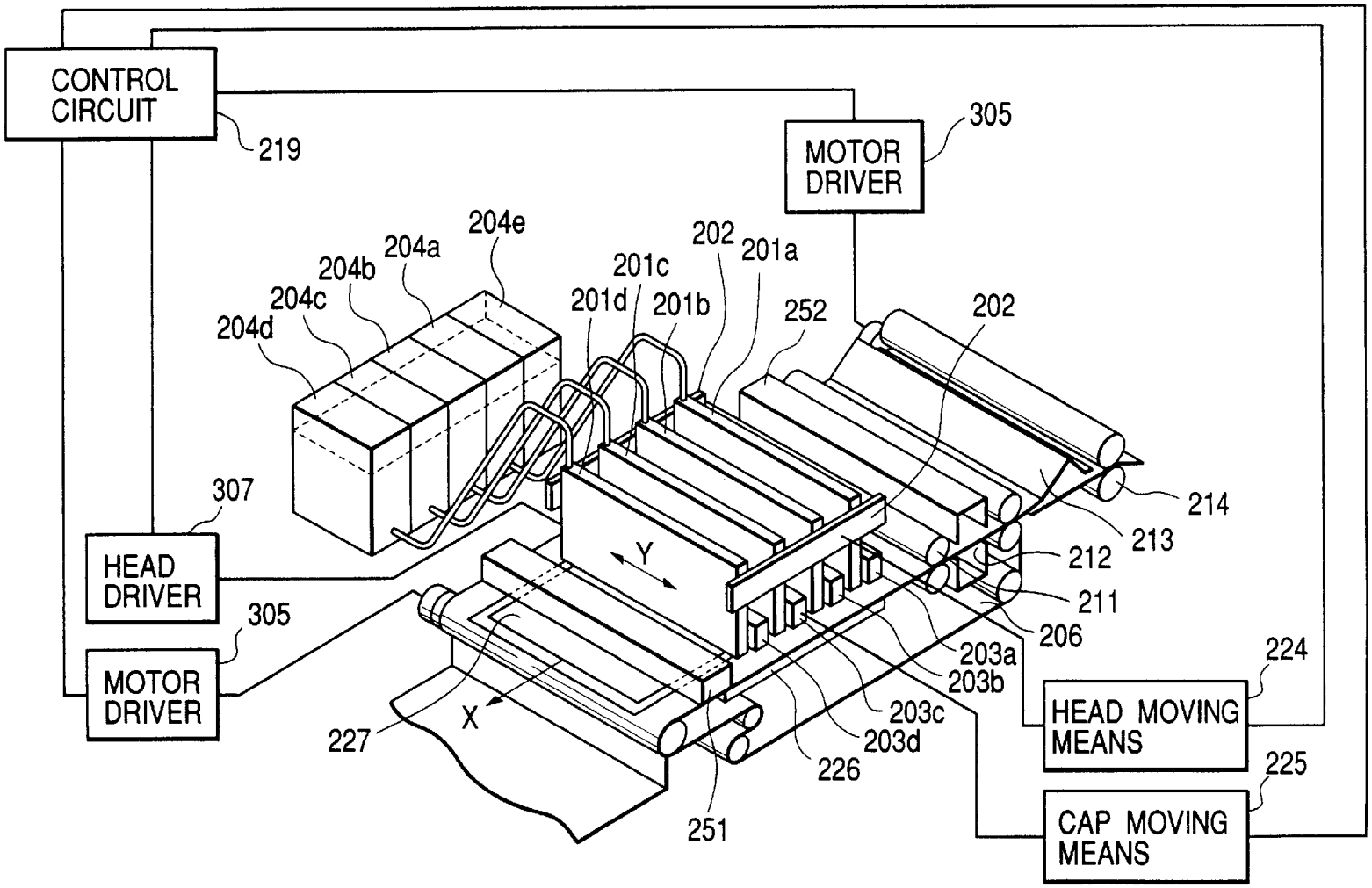
FIG. 9 is a schematic diagram descriptive of a configurational example of the ink jet recording system which uses the ink jet cartridge according to the present invention.

FIG. 9 is a schematic diagram descriptive of a configurational example of the ink jet recording system which uses the ink jet cartridge according to the present invention.

The ink jet cartridge used in this embodiment is a full line type head which has a plurality of discharge ports arranged at intervals of 360 dpi for a length corresponding to a recording width of a recording medium 227, and four heads corresponding to four colors of yellow (Y), magenta (M), cyanic (C) and black (B) are fixed and held in parallel with one another by a holder 202 at predetermined intervals in an X direction.

Signals are supplied from a head driver 307 which composes driving signal supply means to these heads respectively and the heads are driven on the basis of these signals.

Ink in four colors of Y, M, C and Bk is supplied to the heads as discharge liquids from ink tanks 204*a* to 204*d*. In addition, a bubbling liquid is stored in a bubbling liquid container 204*e* so that the bubbling liquid is supplied from this container to the heads.

Furthermore, disposed under the heads are head caps 203*a* to 203*d* which contain an ink absorbing member such as sponge and cover discharge ports of the heads for maintenance while recording is not performed.

Furthermore, a carrying belt 206 which composes carrying means for carrying the various kinds of recording media mentioned above is stretched around various kinds of rollers for a predetermined course and driven by a driving roller connected to the motor driver 305.

In the ink jet recording system preferred as this embodiment, a pretreatment device 251 and a post-treatment device 252 which perform various kinds of treatments on the recording medium before and after recording are disposed upstream and downstream respectively of a recording medium carrying path.

Contents of the pretreatments and the post-treatments are different dependently on kinds of recording media and kinds of ink which are used for recording.

Recording media made of metal, plastic and ceramic materials, for example, are irradiated with ultraviolet rays or ozone as a pretreatment to activate surfaces of the recording media and enhance an adherability of ink.

Furthermore, dust is liable to adhere to a recording medium made of a material such as a plastic material which is liable to generate static electricity and hinders favorable recording in some cases. It is therefore desirable to discharge the static electricity from the recording medium as a pretreatment using an ionizer, thereby removing the dust from the recording medium.

When cloth is to be used as a recording medium, a pretreatment is to be carried out to impart to the cloth a substance selected from among an alkaline substance, a water-soluble substance, a synthetic polymer, a water-soluble metal salt, urea and thiourea from viewpoints of prevention of oozing, enhancement of percentage exhaustion and so on.

The pretreatment is not limited to that which is described above and may be a treatment to heat the recording medium to a temperature adequate for recording.

On the other hand, post-treatments are carried out to accelerate fixing of ink by thermally treating the recording medium to which ink has been applied or irradiating the recording medium with ultraviolet rays, and wash off treating agents which are applied for the pretreatment and remain in conditions not reacted.

Though the embodiment has been described above as the ink jet recording system which uses the full line head, the present invention is not limited by this embodiment and may be a type which performs recording using a small head which is carried in a direction of width of a recording medium as described above.

Since the ceiling surface of the liquid chamber which holds ink discharged from the discharge port has a curved surface convex inward as described above in the ink jet cartridge according to the present invention, the ceiling surface has a region where the sectional area of the liquid chamber is smoothly narrowed to the location at which the bubble is stagnant in the direction of the ink flow from the ink supply port to the ink discharge port and then smoothly enlarged. Accordingly, the ink flows free from reduction of its flow velocity in the vicinity of the ceiling surface when the suction recovery is performed from the discharge port, whereby the ink jet cartridge according to the present invention is capable of removing a bubble which remains in the liquid chamber without enhancing a suction pressure.

Furthermore, since the maximum area of the section of the common liquid chamber perpendicular to the substrate is not larger than 2.5 times of the area of the opening of the ink supply port, the ink jet cartridge according to the present invention is capable of minimizing a reduction of a flow velocity of ink when the ink is introduced from the supply path into the liquid chamber at the suction recovery operation, thereby having improved bubble removing performance.

Furthermore, since the region which communicates with the liquid chamber and has a sectional area enlarged toward the liquid chamber is reserved in the flow path, the ink jet cartridge according to the present invention allows ink to flow smoothly upstream of the flow path, thereby being capable of preventing a bubble from remaining in the vicinity of an upstream section of the flow path.

What is claimed is:

1. An ink jet recording head, comprising:

a discharge port for discharging ink;

a liquid flow path which communicates with said discharge port and in which a heat energy generating element is disposed for generating heat energy to be utilized for discharging the ink, a common liquid chamber which is disposed for supplying the ink into said liquid flow path as the ink is discharged and which is located on a side of said liquid flow path opposite said discharge port; and an ink supply port for supplying the ink into said common liquid chamber, wherein said common liquid chamber has a convex curved surface inside of said common liquid chamber in a region adjacent to said ink supply port, and wherein a surface opposed to a surface of said liquid flow path which has said energy generating element has a slanted portion, such that a cross-sectional area of said liquid flow path increases in a direction from said discharge port toward said common liquid chamber.

2. The inkjet recording head according to claim 1, wherein said ink supply port is disposed in a region which is opposed to said discharge port.

3. An ink jet recording apparatus comprising a carriage on which the ink jet recording head according to claim 1 is mounted and configured to perform recording on a recording medium by sliding said carriage over the recording medium.

4. An ink jet recording head, comprising:

a substrate on which a plurality of energy generating elements for generating discharging energy are disposed; and a ceiling plate having a plurality of grooves composing liquid flow paths corresponding to a plurality of discharge ports for discharging ink respectively, and an integrally formed concavity that communicates with said grooves respectively, composing a common liquid chamber for supplying ink to said plurality of liquid flow paths and having an ink supply port, said ceiling plate being joined to said substrate, wherein the concavity of said ceiling plate has a curved surface which is convex toward said substrate in a region between said grooves and said ink supply port, and wherein a surface opposed to a surface of said flow path having said energy generating element has a slanted portion, such that a cross-sectional area increases in a direction from said discharge port toward said liquid chamber.

5. The ink jet recording head according to claim 4, wherein said ink supply port is disposed in a region which is opposed to said discharge port.

6. An ink jet recording head, comprising:

a substrate on which a plurality of energy generating elements for generating discharging energy are disposed; and a ceiling plate having a plurality of grooves composing liquid flow paths corresponding to a plurality of discharge ports for discharging ink respectively, and an integrally formed concavity that communicates with said grooves respectively, composing a common liquid chamber for supplying ink to said plurality of liquid flow paths and having an ink supply port, said ceiling plate being joined to said substrate, wherein the concavity of said ceiling plate has a curved surface which is convex toward said substrate in a region between said grooves and said ink supply port, and wherein a radius of curvature of said curved surface is not shorter than a length of said common liquid chamber in a flow direction of ink.

7. The ink jet recording head according to claim 6, wherein the radius of curvature of said curved surface is not longer than 1.5 times the length of said common liquid chamber in the flow direction of the ink.

8. The ink jet recording head according to claim 4, wherein the concavity of said ceiling plate has a flat surface which is substantially in parallel with said substrate in the vicinity of a section that communicates with said plurality of grooves, and said flat surface is continuous with said curved surface.

9. An ink jet recording head, comprising:

a substrate on which a plurality of energy generating elements for generating discharging energy are disposed; and a ceiling plate having a plurality of grooves composing liquid flow paths corresponding to a plurality of discharge ports for discharging ink respectively, and an integrally formed concavity that communicates with said grooves respectively, composing a common liquid chamber for supplying ink to said plurality of liquid flow paths and having an ink supply port, said ceiling plate being joined to said substrate, wherein the concavity of said ceiling plate has a curved surface which is convex toward said substrate in a region between said grooves and said ink supply port, and wherein a cross-section of said common liquid chamber which is perpendicular to said substrate has a maximum area not larger than 2.5 times an area of an opening of said ink supply port.

10. An ink jet recording apparatus comprising a carriage on which the ink jet recording head according to claim 4 is mounted and configured to perform recording on a recording medium by sliding said carriage over the recording medium.

* * * * *